US011441242B2

(12) United States Patent
Ito et al.

(10) Patent No.: US 11,441,242 B2
(45) Date of Patent: Sep. 13, 2022

(54) METHOD FOR MANUFACTURING POLYACETAL FIBER

(71) Applicant: MITSUBISHI GAS CHEMICAL COMPANY, INC., Tokyo (JP)

(72) Inventors: Akira Ito, Tokyo (JP); Daisuke Sunaga, Mie (JP); Sunao Mikami, Mie (JP)

(73) Assignee: MITSUBISHI GAS CHEMICAL COMPANY, INC., Tokyo (JP)

( * ) Notice: Subject to any disclaimer, the term of this patent is extended or adjusted under 35 U.S.C. 154(b) by 530 days.

(21) Appl. No.: 16/619,659

(22) PCT Filed: Jun. 8, 2018

(86) PCT No.: PCT/JP2018/021958
§ 371 (c)(1),
(2) Date: Dec. 5, 2019

(87) PCT Pub. No.: WO2019/012877
PCT Pub. Date: Jan. 17, 2019

(65) Prior Publication Data

US 2020/0181806 A1 Jun. 11, 2020

(30) Foreign Application Priority Data

Jul. 14, 2017 (JP) ..... JP2017-138147

(51) Int. Cl.
*D01D 7/00* (2006.01)
*D01F 6/34* (2006.01)
(Continued)

(52) U.S. Cl.
CPC ..... *D01D 5/08* (2013.01); *D01D 5/16* (2013.01); *D01F 6/50* (2013.01); *D02J 1/225* (2013.01)

(58) Field of Classification Search
CPC ... D01D 5/08; D01D 5/16; D01D 7/00; D01F 6/34; D01F 6/50; D02J 1/22; D02J 1/228
(Continued)

(56) References Cited

U.S. PATENT DOCUMENTS

2004/0175566 A1 9/2004 Kikutani et al.
2015/0225536 A1 8/2015 Ito
(Continued)

FOREIGN PATENT DOCUMENTS

CN 1715464 A 1/2006
CN 104499087 4/2015
(Continued)

OTHER PUBLICATIONS

Official Communication issued in International Application No. PCT/JP2018/021958, dated Aug. 14, 2018.

*Primary Examiner* — Leo B Tentoni
(74) *Attorney, Agent, or Firm* — Greenblum & Bernstein, P.L.C.

(57) ABSTRACT

The present invention provides a method for manufacturing a polyacetal fiber in which whiteness irregularity is improved. One embodiment of the present invention provides a method for manufacturing a polyacetal fiber, wherein the method includes a discharge step, a takeup step, a stretching step, and a winding step, the steps being continuously performed, an oxymethylene copolymer being used as the raw material of the polyacetal fiber, the oxymethylene copolymer having an oxymethylene unit and an oxyethylene unit, the content of the oxyethylene unit being 0.5-7.0 moles to 100 moles of the oxymethylene unit, the roller temperature of a stretching unit used in the stretching step being 130-155° C., and operation parameters of the method being set so as to satisfy a prescribed numerical formula.

4 Claims, 1 Drawing Sheet

(51) Int. Cl.

| | |
|---|---|
| ***D02J 1/22*** | (2006.01) |
| ***D01D 5/08*** | (2006.01) |
| ***D01F 6/50*** | (2006.01) |
| ***D01D 5/16*** | (2006.01) |

(58) Field of Classification Search
USPC ..... 264/210.7, 210.8, 211.12
See application file for complete search history.

(56) References Cited

U.S. PATENT DOCUMENTS

| | | | |
|---|---|---|---|
| 2015/0315725 | A1 | 11/2015 | Uehata et al. |
| 2018/0080149 | A1 | 3/2018 | Ito |
| 2018/0179670 | A1 | 6/2018 | Ito et al. |
| 2018/0266018 | A1 | 9/2018 | Ito et al. |

FOREIGN PATENT DOCUMENTS

| | | | |
|---|---|---|---|
| JP | 50-121522 | A | 9/1975 |
| JP | 56-96914 | S | 8/1984 |
| JP | 61-289116 | A | 12/1986 |
| JP | 2001-172821 | | 6/2001 |
| JP | 2002-146637 | | 5/2002 |
| JP | 2003-89925 | | 3/2003 |
| JP | 2008-308791 | | 12/2008 |
| JP | 4907023 | | 1/2012 |
| JP | 2013-170251 | A | 9/2013 |
| JP | 2013-227712 | | 11/2013 |
| JP | 2013-241701 | A | 12/2013 |
| JP | 2016-204817 | A | 12/2016 |
| WO | 2014/050448 | | 4/2014 |
| WO | 2014112423 | A1 | 7/2014 |
| WO | 2016/147998 | | 9/2016 |
| WO | 2017/047459 | | 3/2017 |
| WO | 2017/047460 | | 3/2017 |

METHOD FOR MANUFACTURING POLYACETAL FIBER

TECHNICAL FIELD

The present invention relates to a method for producing a polyacetal fiber.

BACKGROUND ART

A polyacetal is a polymer having a polymer skeleton mainly composed of the repeat of an oxymethylene unit, and because of its characteristics including mechanical strength, chemical resistance and solvent resistance, it is used mainly as a material for injection molding in a wide range of fields including automobiles and electric appliances.

As methods for producing a polyacetal fiber, a method for producing a fiber having high strength and high elastic modulus (Patent Document 1), a method for producing a high-strength fiber having heat resistance, abrasion resistance and chemical resistance (Patent Document 2), etc. have been disclosed.

PRIOR ART DOCUMENTS

Patent Documents

Patent Document 1: Japanese Patent No. 4907023
Patent Document 2: Japanese Laid-Open Patent Publication No. 2001-172821

SUMMARY OF THE INVENTION

Problems to be Solved by the Invention

Though the polyacetal is a resin material having excellent physical properties as described above, when it is spun as a fiber according to a conventional method, the color of a polyacetal fiber obtained may be whitish. When the color of the fiber has such unevenness, problems may occur, for example, thickness unevenness of the fiber may be increased, or workability may be unstable at the time of subsequent false twisting and weaving/knitting.

The present inventors found out that whiteness unevenness tends to be caused more in the polyacetal fiber when compared to general resin fibers such as polyester fibers. Accordingly, the purpose of the present invention is to provide a method for producing a polyacetal fiber, wherein whiteness unevenness is improved.

Means for Solving the Problems

The present inventors diligently made researches in order to solve the above-described problem and found that the problem can be solved by a production method, wherein an oxymethylene copolymer containing an oxymethylene unit and an oxyethylene unit at a predetermined ratio is used as a raw material, and wherein operation parameters are set so as to satisfy a certain numerical formula, and thus the present invention was achieved.

The present invention is, for example, as described below.

[1] A method for producing a polyacetal fiber, wherein:

the method comprises a discharge step, a take-off step, a drawing step and a winding step, the steps being successively carried out;

an oxymethylene copolymer is used as a raw material of the polyacetal fiber, the oxymethylene copolymer having an oxymethylene unit and an oxyethylene unit, the content of the oxyethylene unit being 0.5 to 7.0 mol relative to 100 mol of the oxymethylene unit;

the roller temperature of a drawing unit used in the drawing step is 130 to 155° C.; and when a value obtained by dividing a rate difference between a rate of discharging the oxymethylene copolymer from a discharge nozzle in the discharge step and a rate of taking off the fiber using a take-off roller in the take-off step by a distance between the discharge nozzle and the take-off roller is referred to as a rate difference per unit distance x (1/sec) and defined as formula (A):

$$\text{Rate difference per unit distance}(x)=(\text{rate of take-off roller(m/sec)}-\text{rate of discharging resin from discharge nozzle(m/sec)})/\text{distance}(m) \quad \text{(A)},$$

and the ratio between an area of the discharge nozzle and a cross-sectional area of the polyacetal fiber after the winding step is referred to as an area ratio y (no unit dimension) and defined as formula (B):

$$\text{Area ratio}(y)=\text{area of discharge nozzle}(\text{mm}^2)/\text{cross-sectional area of polyacetal fiber after winding step}(\text{mm}^2) \quad \text{(B)},$$

formula (C) below is satisfied:

$$y>1600/x \quad \text{(C)}$$

with the proviso that $1.5<x<15$.

[2] The method according to item [1], wherein $1400<y<2500$ is satisfied in formula (C).

[3] The method according to item [1] or [2], wherein formula (D) below is satisfied:

$$y>8000/x \quad \text{(D)}$$

with the proviso that $1.5<x<15$.

DESCRIPTION OF EMBODIMENTS

Figure 1:
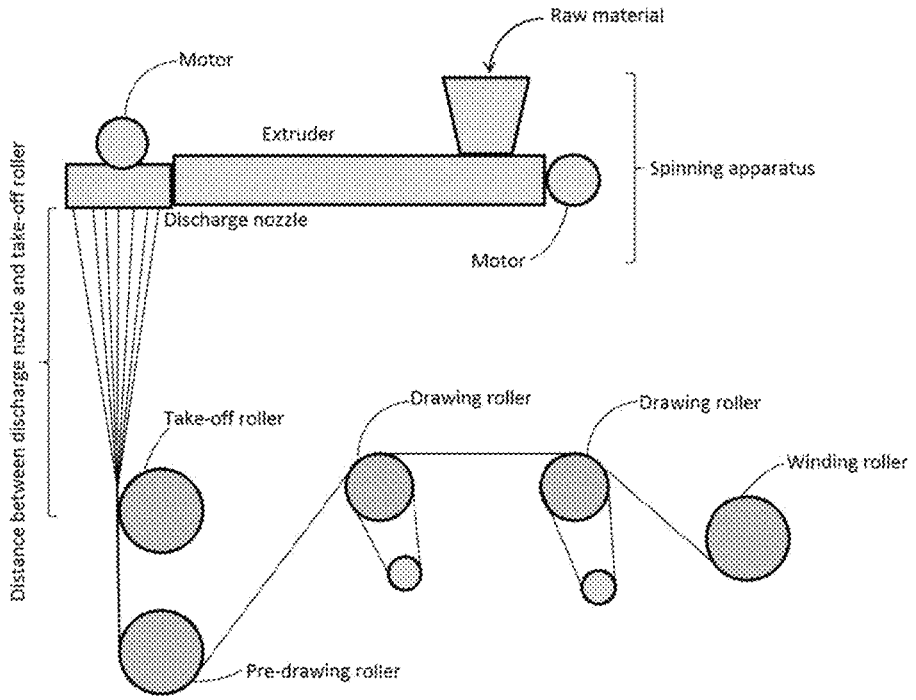
FIG. 1 is a schematic view of an apparatus for producing a polyacetal fiber.
Figure 2:
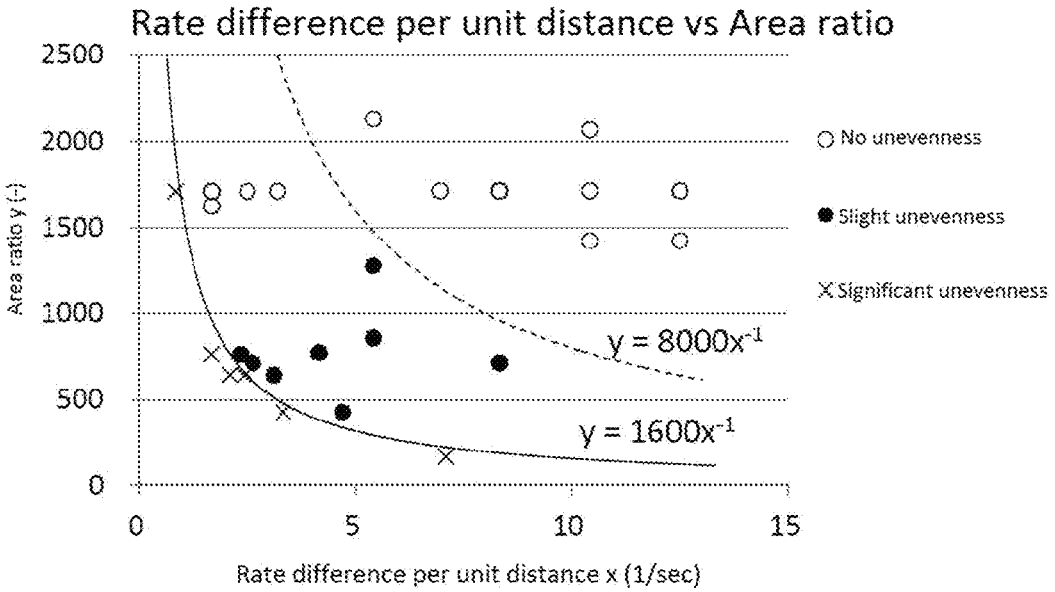
FIG. 2 is a graph showing the relationship between the rate difference per unit distance and the area ratio.

Hereinafter, the present invention will be described in detail by way of production examples, working examples, etc., but the present invention is not limited thereto and can be arbitrarily changed and then practiced within a range not departing from the gist of the present invention.

<Method for Producing Polyacetal Fiber>

The method for producing a polyacetal fiber of the present invention is a method of obtaining a polyacetal fiber by using an oxymethylene copolymer containing an oxymethylene unit and an oxyethylene unit at a predetermined ratio as a raw material. This production method comprises: a discharge step for discharging the polyacetal fiber from a discharge nozzle of a spinning apparatus; a take-off step for taking off the discharged polyacetal fiber; a drawing step for drawing the taken-off polyacetal fiber; and a winding step for winding the drawn polyacetal fiber, and these steps are successively carried out. In addition, in the method for producing the polyacetal fiber of the present invention: the roller temperature of a drawing unit used in the drawing step is 130 to 155° C.; and when a value obtained by dividing a rate difference between a rate of discharging the oxymethylene copolymer from the discharge nozzle in the discharge step and a rate of taking off the fiber using a take-off roller in the take-off step by a distance between the discharge nozzle and the take-off roller is referred to as a rate difference per unit distance x (1 sec) and defined as formula (A):

Rate difference per unit distance($x$)=(rate of take-off roller(m/sec)−rate of discharging resin from discharge nozzle(m/sec))/distance($m$) (A), and the ratio between an area of the discharge nozzle and a cross-sectional area of the polyacetal fiber after the winding step is referred to as an area ratio y (no unit dimension) and defined as formula (B):

Area ratio($y$)=area of discharge nozzle($mm^2$)/cross-sectional area of polyacetal fiber after winding step($mm^2$) (B), formula (C) below is satisfied:

$$y>1600/x \quad (C)$$

with the proviso that $1.5<x<15$.

As described above, the present inventors unexpectedly found that whiteness unevenness is improved by the production method, wherein the oxymethylene copolymer containing the oxymethylene unit and the oxyethylene unit at a predetermined ratio is used as a raw material, and wherein operation parameters are set so as to satisfy the above-described numerical formula. The present inventors further found that not only whiteness unevenness, but also spinnability of the fiber is improved according to one embodiment of the present invention.

One embodiment of the method for producing the polyacetal fiber of the present invention will be described using the schematic view of FIG. 1. In one embodiment of the present invention, the polyacetal fiber is produced by taking off a plurality of fibrous materials (filaments) discharged from a discharge nozzle of a spinning apparatus using a take-off roller to make a fiber, followed by drawing it using a pre-drawing roller and a drawing roller, and after the drawing step, the drawn fiber is wound with a winding roller. Further, the discharge step, the take-off step, the drawing step and the winding step are successively carried out. As used herein, "successively carried out" means that the respective steps are not carried out separately, but carried out as a series of steps. For example, it means a process in which a fiber taken off in the take-off step is directly drawn in the drawing step. Note that the method for producing the polyacetal fiber of the present invention can be applied not only to a multifilament spinning method like that of FIG. 1, but also to a monofilament spinning method.

The constitution of the spinning apparatus to be used for the production method of the present invention is not particularly limited, and it is sufficient when it can melt the oxymethylene copolymer as the raw material and can discharge the polyacetal fiber from the discharge nozzle. According to need, the spinning apparatus may have an extruder or the like to melt-knead the oxymethylene copolymer as the raw material in the spinning apparatus. Examples of the spinning apparatus include general multifilament or monofilament melt spinning apparatuses configured with a single screw extruder, a gear pump, a screen and a die. Further, the cylinder temperature of the extruder, the temperature of the gear pump, the number of holes of the discharge nozzle, etc. can be suitably adjusted according to need. Moreover, the fineness (fiber thickness) of the fiber after drawing can be suitably adjusted by the feed amount of the raw material and the rate of the winding roller.

The filaments discharged from the discharge nozzle of the spinning apparatus are firstly taken off by the take-off roller as the polyacetal fiber, then sent to the pre-drawing roller, and then drawn by using at least one drawing roller. By performing drawing, the tensile strength of the fiber can be improved. As used herein, the "pre-drawing roller" refers to a roller arranged between the drawing roller and the take-off roller, and usually between the pre-drawing roller and the take-off roller, the fiber is not drawn or slightly drawn for the purpose of ensuring spinning stability. Further, the "drawing roller" refers to a roller arranged after the pre-drawing roller, and the fiber is drawn between the pre-drawing roller and the drawing roller and/or between a plurality of drawing rollers. In the method for producing the polyacetal fiber of the present invention, at least one drawing roller is used, and preferably, two or more drawing rollers are used. It is preferred to use two or more drawing rollers because the polyacetal fiber can be drawn in a plurality of stages.

In the production method of the present invention, the temperature of the roller of the drawing unit is 130 to 155° ° C. As used herein, "the roller of the drawing unit" means at least one of a pre-drawing roller and at least one drawing roller. Accordingly, it is not particularly limited as long as at least one of the pre-drawing roller and the at least one drawing roller is at a temperature of 130 to 155° C. It is preferred that the temperature of the at least one drawing roller is 130 to 155° C., and it is more preferred that the temperature of both of the at least one drawing roller and the pre-drawing roller is 130 to 155° C. When the roller temperature is 130° C. or higher, the resin becomes sufficiently soft and breakage of the fiber before drawn in the drawing step can be effectively suppressed. Further, when the roller temperature is 155° C. or lower, it is sufficiently far from the melting point of the resin and sticking of the fiber on the roller can be suppressed, and therefore breakage of the fiber can be effectively suppressed.

As described above, in the production method of the present invention, the polyacetal fiber in which whiteness unevenness is improved can be obtained when the rate difference per unit distance (x) and the area ratio (y) obtained from formulae (A) and (B) satisfy formula (C) above. The respective formulae will be described below.

Formula (A) below defines the rate difference per unit distance (x).

Rate difference per unit distance($x$)=(rate of take-off roller(m/sec)−rate of discharging resin from discharge nozzle(m/sec))/distance($m$) (A)

Specifically, the value obtained by dividing the rate difference between the rate of discharging the oxymethylene copolymer from the discharge nozzle in the discharge step and the rate of taking off the fiber using the take-off roller in the take-off step by the distance between the discharge nozzle and the take-off roller is defined as the rate difference per unit distance x (1/sec). As used herein, "the rate of discharging the oxymethylene copolymer from the discharge nozzle in the discharge step" means a linear velocity (m/sec) of the resin (oxymethylene copolymer) discharged from the discharge nozzle of the spinning apparatus at the discharge nozzle. Further, as used herein. "the distance between the discharge nozzle and the take-off roller" means a distance (m) from the discharge nozzle of the spinning apparatus to the center of the take-off roller as shown in FIG. 1. It is considered that at the time of taking off the fiber extruded from the discharge nozzle of the extruder using the take-off roller during spinning, the condition until the extruded resin is solidified by being exposed to the open air while being taken off is important, and for this reason, formula (A) above is set as a parameter.

Formula (B) below defines the area ratio (y).

$$\text{Area ratio}(y)=\text{area of discharge nozzle}(mm^2)/\text{cross-sectional area of polyacetal fiber after winding step}(mm^2) \quad (B)$$

Specifically, the ratio between the area of the discharge nozzle and the cross-sectional area of the polyacetal fiber after the winding step is defined as the area ratio y (no unit dimension). As used herein, the area of the discharge nozzle ($mm^2$) means an area per one discharge nozzle of the spinning apparatus from which the resin is discharged. The area ratio (y) in formula (B) can be obtained by dividing the area of the discharge nozzle by the cross-sectional area per one polyacetal fiber after the winding step ($mm^2$). It is considered that for the matter as to whether or not a fiber finally obtained is excellent with small whiteness unevenness, it is important what kind of conditions of the fiber are finally obtained after the fiber extruded from the discharge nozzle of the extruder is passed through the take-off roller and the drawing roller to reach the winding roller in the entire spinning process, and for this reason, formula (B) above is set as a parameter.

Formula (C) below defines the relationship between the rate difference per unit distance (x) and the area ratio (y):

$$y>1600/x \quad (C)$$

with the proviso that $1.5<x<15$.

Specifically, the polyacetal fiber in which whiteness unevenness is improved can be obtained when the rate difference per unit distance (x) and the area ratio (y) obtained from formulae (A) and (B) above satisfy formula (C) above. According to a preferred embodiment of the present invention, in formula (C) above, $1400<y<2500$ is satisfied.

According to the production method according to a preferred embodiment of the present invention, formula (D) below is satisfied.

$$y>8000/x \quad (D)$$

(with the proviso that $1.5<x<15$)

The polyacetal fiber in which whiteness unevenness is more improved can be obtained when formula (D) above is satisfied.

The take-off rate (m/min) of the take-off roller and the winding rate (m/min) of the winding roller are not particularly limited as long as the above-described formula (C) can be satisfied thereby, but for example, the take-off rate (m/min) of the take-off roller and the take-off rate (m/min) of the pre-drawing roller are preferably 300 to 6000 m/min, and particularly preferably 400 to 3000 m/min. The drawing roller and the winding rate (m/min) of the winding roller are preferably 1000 to 6000 m/min, and particularly preferably 2000 to 6000 m/min. It is preferred that the rotation rate of the pre-drawing roller is almost equal to the take-off rate of the take-off roller. There is no problem when the winding rate of the winding roller is almost equal to the rotation rate of the drawing roller, but in consideration of shrinkage of the polyacetal fiber, it is preferred that the winding rate is slightly lower than the rotation rate of the drawing roller.

According to a preferred embodiment of the present invention, drawing can be carried out in a multistage manner in the drawing step using the pre-drawing roller and two or more drawing rollers. By performing drawing in a multistage manner, spinning stability and secondary workability can be further improved.

According to a preferred embodiment of the present invention, the drawing step is carried out using a pre-drawing roller and two or more drawing rollers, and in the drawing step, the polyacetal fiber is passed through the pre-drawing roller and then the two or more drawing rollers, and the temperature of at least one of the two or more drawing rollers is 3 to 20° C., and preferably 5 to 20° C. higher than the temperature of the pre-drawing roller. In the constitution in which the drawing step is carried out using the pre-drawing roller and the two or more drawing rollers, wherein the polyacetal fiber is passed through the pre-drawing roller and then the two or more drawing rollers, by adjusting the temperatures of the pre-drawing roller and drawing rollers, spinning stability is improved. According to a more preferred embodiment of the present invention, in the drawing step, the temperature of the pre-drawing roller and the temperature of at least one of the two or more drawing rollers are 130 to 155° C. By adjusting the temperatures of the pre-drawing roller and drawing rollers as described above, it is possible to obtain a polyacetal fiber having good spinnability.

The discharge amount of the resin spun from one hole of the extruder nozzle is not particularly limited as long as it can satisfy the above-described formula (C), but it is preferably 0.001 to 0.5 kg/h, more preferably 0.01 to 0.10 kg/h, and even more preferably 0.05 to 0.09 kg/h.

The hole size of the extruder nozzle is not particularly limited as long as it can satisfy the above-described formula (C), but it is preferably 0.1 to 1.0 mm, and more preferably 0.2 to 0.6 mm.

The diameter of the single fiber thickness of the polyacetal fiber after the winding step is not particularly limited, but it is preferably 0.001 to 0.10 mm, more preferably 0.01 to 0.03 mm, and even more preferably 0.01 to 0.02 mm.

<Polyacetal Fiber>

The polyacetal fiber of the present invention is a polymer fiber having an oxymethylene structure as a unit structure and can be obtained by spinning an oxymethylene copolymer according to the production method of the present invention. The polyacetal fiber of the present invention is excellent with respect to whiteness unevenness, and the entire fiber has uniform and transparent whiteness. In a preferred embodiment of the present invention, the polyacetal fiber of the present invention is also excellent in spinnability. As used herein, "spinnability" refers to an index which indicates whether or not the fiber can be stably obtained (the fiber is not broken during spinning and the operation is not stopped). The criteria of the index will be specifically described in the Examples.

The oxymethylene copolymer to be used as a raw material for the polyacetal fiber in the production method of the present invention has an oxymethylene unit and an oxyethylene unit, and the content of the oxyethylene unit is 0.5 to 7.0 mol, preferably 1.0 to 4.0 mol, and more preferably 1.0 to 2.5 mol relative to 100 mol of the oxymethylene unit. The content of the oxymethylene unit and the oxyethylene unit in the oxymethylene copolymer can be measured according to the nuclear magnetic resonance (NMR) method.

As the oxymethylene copolymer to be used as a raw material for the polyacetal fiber in the production method of the present invention, in addition to the above-described oxymethylene copolymer having a polyoxymethylene unit and a polyoxyethylene unit, another oxymethylene copolymer may also be included. As such an oxymethylene copolymer, an oxymethylene copolymer having an oxyalkylene unit represented by formula (1) below in the molecule other than the oxymethylene unit can be used:

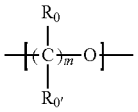

(1)

where $R_0$ and $R_0'$ may be the same or different and are a hydrogen atom, an alkyl group, a phenyl group or an alkyl group interrupted by at least one ether bond; and m is an integer of 2 to 6.

The alkyl group is a substituted or unsubstituted and linear or branched alkyl group having 1 to 20 carbon atoms, and it is preferably a linear or branched alkyl group having 1 to 4 carbon atoms. Examples of the alkyl group include methyl, ethyl, n-propyl, i-propyl, n-butyl, i-butyl, t-butyl, pentyl, hexyl, decyl, dodecyl and octadecyl.

Examples of substituents include a hydroxy group, an amino group, an alkoxy group, an alkenyloxymethyl group and halogen. In this regard, examples of the alkoxy group include methoxy, ethoxy and propoxy. Further, examples of the alkenyloxymethyl group include allyloxymethyl.

The phenyl group is an unsubstituted phenyl group, or a phenyl group substituted with substituted or unsubstituted alkyl group, a substituted or unsubstituted aryl group or halogen. In this regard, examples of the aryl group include phenyl, naphthyl and anthracyl.

Examples of the alkyl group interrupted by at least one ether bond include a group represented by formula (2) below:

$$—CH_2—O—(R_1—O)—R_2 \quad (2)$$

where $R_1$ is an alkylene group; p represents an integer of 0 to 20; $R_2$ is a hydrogen atom, an alkyl group, a phenyl group or a glycidyl group; and ($R_1$—O) units may be the same or different.

The alkylene group is a linear or branched and substituted or unsubstituted alkylene group having 2 to 20 carbon atoms, and examples thereof include ethylene, propylene, butylene and 2-ethylhexylene. The alkylene as $R_1$ is preferably ethylene or propylene.

It is preferred that $R_0$ and $R_0'$ are the same and are a hydrogen atom.

Examples of the oxyalkylene unit represented by formula (1) include an oxyethylene unit, an oxypropylene unit, an oxybutylene unit, an oxypentylene unit and an oxyhexylene unit. Preferred are an oxyethylene unit, an oxypropylene unit and an oxybutylene unit, and more preferred is an oxyethylene unit.

The oxymethylene copolymer can further have a unit represented by formula (3) below:

$$—CH(CH_3)—CHR_3— \quad (3)$$

where $R_3$ is a group represented by formula (4) below:

$$—O—(R_1—O)_p—R_4 \quad (4)$$

where $R_4$ is a hydrogen atom, an alkyl group, an alkenyl group, a phenyl group or a phenylalkyl group; and $R_1$ and p are as defined with respect to formula (2).

The alkenyl group is a linear or branched and substituted or unsubstituted alkenyl group having 2 to 20 carbon atoms, and examples thereof include vinyl, allyl and 3-butenyl.

Examples of the alkyl moiety and the phenyl moiety in the phenylalkyl group include those mentioned with respect to the alkyl group and the phenyl group above. Examples of the phenylalkyl group include benzyl, phenylethyl, phenylbutyl, 2-methoxybenzyl, 4-methoxybenzyl and 4-(allyloxymethyl) benzyl.

In the present invention, when a crosslinking structure exists, the alkenyl group and the glycidyl group in the group represented by formula (2) or the alkenyl group in the group represented by formula (4) can be a crosslinking point in a further polymerization reaction, and the crosslinking structure is formed thereby.

The method for producing the oxymethylene copolymer is not particularly limited, and examples thereof include a method in which trioxane that is a trimer of formaldehyde and a comonomer are subjected to a bulk polymerization using a cationic polymerization catalyst such as boron trifluoride, perchloric acid and heteropolyacid. Examples of the comonomer include: a cyclic ether having 2 to 8 carbon atoms such as ethylene oxide, 1,3-dioxolane, 1,3,5-trioxepane and 1,3,6-trioxocan; and a cyclic formal having 2 to 8 carbon atoms such as a cyclic formal of glycol and a cyclic formal of diglycol. By these comonomers, the oxyalkylene unit represented by formula (1), wherein $R_0$ and $R_0'$ are the same and are a hydrogen atom, is formed.

In the present invention, said another oxymethylene copolymer includes a binary copolymer and a multi-component copolymer. Accordingly, as the oxymethylene copolymer to be used in the production method of the present invention, an oxymethylene copolymer which has the oxymethylene unit and the oxyalkylene unit represented by formula (1), an oxymethylene copolymer which includes the oxymethylene unit, the oxyalkylene unit represented by formula (1) and the unit represented by formula (3), an oxymethylene copolymer which further has a crosslinking structure, etc. can be widely used. In the present invention, the unit represented by formula (1), wherein not both of $R_0$ and $R_0'$ are a hydrogen atom, can be formed, for example, by copolymerizing a glycidyl ether compound and/or an epoxy compound, and the unit represented by formula (3) can be formed, for example, by copolymerizing an allyl ether compound.

The glycidyl ether and epoxy compounds are not particularly limited, and examples thereof include: epichlorohydrin; alkyl glycidyl formals such as methyl glycidyl formal, ethyl glycidyl formal, propyl glycidyl formal and butyl glycidyl formal; diglycidyl ethers such as ethylene glycol diglycidyl ether, propylene glycol diglycidyl ether, 1,4-butanediol diglycidyl ether, hexamethylene glycol diglycidyl ether, resorcinol diglycidyl ether, bisphenol A diglycidyl ether, hydroquinone diglycidyl ether, polyethylene glycol diglycidyl ether, polypropylene glycol diglycidyl ether and polybutylene glycol diglycidyl ether; triglycidyl ethers such as glycerin triglycidyl ether and trimethylolpropane triglycidyl ether; and tetraglycidyl ethers such as pentaerythritol tetraglycidyl ether.

Examples of the allyl ether compound include polyethylene glycol allyl ether, methoxypolyethylene glycol allyl ether, polyethylene glycol-polypropylene glycol allyl ether, polypropylene glycol allyl ether, butoxypolyethylene glycol-polypropylene glycol allyl ether, polypropylene glycol diallyl ether, phenylethyl allyl ether, phenylbutyl allyl ether, 4-methoxybenzyl allyl ether, 2-methoxybenzyl allyl ether and 1,4-diallyloxymethylbenzene.

Examples of chain transfer agents include carboxylic acid, carboxylic anhydride, ester, amide, imide, phenols and an acetal compound. Among them, preferred are phenol, 2,6-dimethylphenol, methylal and polyacetal dimethoxide, and more preferred is methylal. Examples of solvents include: aliphatic hydrocarbons such as hexane, heptane and cyclohexane; aromatic hydrocarbons such as benzene, toluene and xylene; and halogenated hydrocarbons such as methylene dichloride and ethylene dichloride. The chain transfer agent can be used solely or in the form of a solution in which the chain transfer agent is dissolved in the solvent. When the chain transfer agent is methylal, usually, the adding amount thereof can be less than $2\times10^{-1}$ wt % relative to trioxane.

Examples of commercially-available products of the oxymethylene copolymer include "Iupital (registered trademark), F20-03" and "Iupital (registered trademark), F40-03" (manufactured by Mitsubishi Engineering-Plastics Corporation).

To the oxymethylene copolymer, a publicly-known additive and/or filler can be added within a range in which the purpose of the present invention is not impaired. Examples of the additive include a crystal nucleating agent, an antioxidant, a plasticizer, a matting agent, a foaming agent, a lubricant, a mold release agent, an antistatic agent, an ultraviolet absorber, a light stabilizer a heat stabilizer, a deodorizer, a flame retardant, a sliding agent, a perfume and an antimicrobial agent. Further, examples of the filler include glass fiber, talc, mica, calcium carbonate and potassium titanate whiskers. In addition, it is also possible to add a pigment or dye thereto to obtain a finished product having a desired color. It is also possible to add a transesterification catalyst, various monomers, a coupling agent (e.g., another polyfunctional isocyanate compound, an epoxy compound, a glycidyl compound, diaryl carbonates, etc.), an end treatment agent, other resins, wood flour and a naturally-occurring organic filler such as starch for modification. The timing of adding the above-described additive, filler, etc, is not limited. These materials may be added at the stage of obtaining the oxymethylene copolymer to carry out the production. Alternatively, these materials may be put into an extruder together with the oxymethylene copolymer at the time of the production of the polyacetal fiber.

The polyacetal fiber obtained by the production method according to one embodiment of the present invention comprises a plurality of filaments. Specifically, the polyacetal fiber is obtained by bundling a plurality of filaments discharged from a plurality of discharge nozzles.

EXAMPLES

Hereinafter, the effects of the embodiments will be described by way of working examples and comparative examples. Note that the technical scope of the present invention is not limited thereto.

<Measurement Methods and Evaluation Methods>

The measurement and the evaluation of respective physical properties with respect to working examples and comparative examples in this specification were carried out according to methods described below.

I. Whiteness Unevenness

The bobbin to which the polyacetal fiber was wound after drawing was visually observed, and it was judged whether or not the polyacetal fiber has whiteness unevenness. In the case of a polyacetal fiber uniformly drawn, the entire fiber has uniform whiteness, whereas in the case of a polyacetal fiber non-uniformly drawn, since insufficiently-drawn portions remain in the fiber, whiteness unevenness is recognized at the time of visual observation.

A: a fiber had almost no unevenness

B: a fiber had slight unevenness but it was within an acceptable range (when the outer appearance of the bobbin was observed and color unevenness was counted in an area of 2 cm×2 cm, the number was from 1 to less than 20)

D: a fiber had significant unevenness and it was not within an acceptable range (when the outer appearance of the bobbin was observed and color unevenness was counted in an area of 2 cm×2 cm, the number was 20 or more)

2. Spinnability

It indicates whether or not the fiber can be stably obtained (the fiber is not broken during spinning and the operation is not stopped).

A: significantly stable (a fiber was not broken during a time period of 3 hours or more)

B: stable (a fiber was not broken during a time period of 1 hour or more and was broken in less than 3 hours)

C: slightly unstable but it was within an acceptable range (a fiber was not broken during a time period of 15 minutes or more and was broken in less than 1 hour)

D: unstable (a fiber was broken in less than 15 minutes)

The method for producing the polyacetal fiber related to working examples and comparative examples will be described below.

Example 1

(1) Preparation of Oxymethylene Copolymer

The oxymethylene copolymer that is the raw material of the polyacetal fiber related to working examples and comparative examples was prepared by the method described below. Firstly, 100 parts by weight of trioxane was mixed with 4.0 parts by weight of 1,3-dioxolane as a comonomer, boron trifluoride diethyl etherate as a catalyst was supplied thereto in an amount of 0.045 mmol per 1 mol of trioxane, and the mixture was polymerized in a twin screw kneader having paddles engaged with each other. At this time, methylal as a viscosity modifier was added in an amount of 0.12 parts by weight relative to 100 parts by weight of trioxane to adjust the viscosity. After the polymerization was completed, the catalyst was deactivated using a small amount of a benzene solution of triphenyl phosphine, and then crushing was carried out, thereby obtaining a crude oxymethylene copolymer.

Subsequently, to the crude oxymethylene copolymer, appropriate additives such as Irganox 245, melamine and PEG 20000 were added and blended, then the mixture was introduced into a co-rotating twin screw extruder (manufactured by The Japan Steel Works, Ltd., inner diameter: 69 mm, L/D=31.5) at a rate of 60 kg/hour, and the polyacetal polymer was melted in a vent part under a reduced pressure of 20 kPa at 220° C. and continuously introduced into a twin screw surface-renewal type horizontal kneader (60 L of the effective inner volume: the volume obtained by subtracting the volume occupied by stirring blades from the total inner volume). The liquid surface control was carried out so that the residence time in the twin screw surface-renewal type horizontal kneader became 25 minutes, and devolatilization was carried out under a reduced pressure of 20 kPa at 220° C. while the material was continuously extracted using a gear pump for palletization, thereby obtaining the oxymethylene copolymer as the raw material. The content of the oxyethylene unit relative to 100 mol % of the oxymethylene unit in the oxymethylene copolymer was measured using an NMR apparatus (AVANCE III500 manufactured by BRUKER).

(2) Spinning Conditions

The oxymethylene copolymer thus obtained was spun using a spinning apparatus equipped with an extruder with its cylinder temperature being set at 190° C., a gear pump and a discharge nozzle (manufactured by UNIPLAS). The discharge amount per hole was 0.028 g/min, the diameter of the hole was 0.6 mm, the number of holes of the discharge nozzle was 36, and the take-off rate was 400 m/min. The rate difference per unit distance x was calculated based on the distance from the hole to the take-off roller.

Subsequently, the taken-off fiber was drawn to obtain a fiber having a predetermined thickness, and the area ratio y between the discharge nozzle and the fiber was calculated based on this. The temperature of the pre-drawing roller was 145° C., and the temperature of the drawing roller was 150° C. The evaluation results are shown in Table 1.

Examples 2-22 and Comparative Examples 1-6

The spinning conditions (discharge amount, take-off rate and fiber thickness) were changed from those of Example 1, and each polyacetal fiber was spun. The evaluation results are shown in Tables 1 and 2.

Examples 23 and 24 and Comparative Examples 7 and 8

At the time of obtaining a crude oxymethylene copolymer, the amount of 1,3-dioxolane was changed. In addition, the spinning conditions were also changed and each polyacetal fiber was spun. The evaluation results are shown in Tables 1 and 2.

As is clear from Tables 1 and 2, in Examples 1-24, when spinning was carried out under conditions tinder which the appropriate content of the oxyethylene unit, linear velocity of the resin at the discharge nozzle, rate of the take-off roller and fiber thickness after the winding step were obtained, whiteness unevenness and spinnability were improved. Meanwhile, in Comparative Examples 1-5, whiteness unevenness was caused. Further, in Comparative Example 6 in which the oxymethylene unit was not contained and Comparative Example 7 in which the amount of the oxyethylene unit relative to 100 mol of the oxymethylene unit was large (8 mol), spinnability was deteriorated and no fiber was successfully obtained.

TABLE 1

| Physical properties or production conditions | Unit | Examples 1 | 2 | 3 | 4 | 5 | 6 | 7 | 8 |
|---|---|---|---|---|---|---|---|---|---|
| Content of oxyethylene unit relative to 100 mol of oxymethylene unit | mol | 1.5 | 1.5 | 1.5 | 1.5 | 1.5 | 1.5 | 1.5 | 1.5 |
| Discharge amount per hole | kg/h · hole | 0.028 | 0.067 | 0.037 | 0.044 | 0.040 | 0.028 | 0.028 | 0.028 |
| Rate of take-off roller | m/min | 400 | 1130 | 560 | 750 | 630 | 400 | 600 | 770 |
| Linear velocity of resin at discharge nozzle | m/min | 0.008 | 0.020 | 0.011 | 0.013 | 0.012 | 0.008 | 0.008 | 0.008 |
| Rate difference per unit distance (x) | l/sec | 1.7 | 4.7 | 2.3 | 3.1 | 2.6 | 1.7 | 2.5 | 3.2 |
| Diameter of polyacetal fiber (single fiber) after winding step | mm | 0.0145 | 0.0290 | 0.0217 | 0.0237 | 0.0225 | 0.0145 | 0.0145 | 0.0145 |
| Diameter of discharge nozzle | mm | 0.60 | 0.60 | 0.60 | 0.60 | 0.60 | 0.60 | 0.60 | 0.60 |
| Area ratio (y) | — | 1709 | 427 | 762 | 641 | 712 | 1709 | 1709 | 1709 |
| 1600/x | | 960 | 340 | 686 | 512 | 610 | 960 | 640 | 499 |
| 8000/x | | 4800 | 1699 | 3429 | 2560 | 3048 | 4800 | 3200 | 2494 |
| Is y > 1600/x satisfied? | | Y | Y | Y | Y | Y | Y | Y | Y |
| Is y > 8000/x satisfied? | | N | N | N | N | N | N | N | N |
| Evaluation results | | | | | | | | | |
| Whiteness unevenness | | A | B | B | B | B | A | A | A |
| Spinnability | | B | C | C | C | C | B | B | B |

| Physical properties or production conditions | Unit | Examples 9 | 10 | 11 | 12 | 13 | 14 | 15 | 16 |
|---|---|---|---|---|---|---|---|---|---|
| Content of oxyethylene unit relative to 100 mol of oxymethylene unit | mol | 1.5 | 1.5 | 1.5 | 1.5 | 1.5 | 1.5 | 1.5 | 1.5 |
| Discharge amount per hole | kg/h · hole | 0.028 | 0.056 | 0.069 | 0.069 | 0.083 | 0.056 | 0.056 | 0.056 |
| Rate of take-off roller | m/min | 400 | 2000 | 2500 | 1670 | 3000 | 1000 | 1300 | 1300 |
| Linear velocity of resin at discharge nozzle | m/min | 0.008 | 0.016 | 0.020 | 0.020 | 0.024 | 0.020 | 0.020 | 0.020 |
| Rate difference per unit distance (x) | l/sec | 1.7 | 8.3 | 10.4 | 7.0 | 12.5 | 4.2 | 5.4 | 5.4 |
| Diameter of polyacetal fiber (single fiber) after winding step | mm | 0.0149 | 0.0145 | 0.0132 | 0.0145 | 0.0145 | 0.0216 | 0.0205 | 0.0168 |
| Diameter of discharge nozzle | mm | 0.60 | 0.60 | 0.60 | 0.60 | 0.60 | 0.60 | 0.60 | 0.60 |
| Area ratio (y) | — | 1624 | 1712 | 2066 | 1712 | 1712 | 772 | 857 | 1276 |
| 1600/x | | 960 | 192 | 154 | 230 | 128 | 384 | 295 | 295 |
| 8000/x | | 4800 | 960 | 768 | 1150 | 640 | 1920 | 1477 | 1477 |
| Is y > 1600/x satisfied? | | Y | Y | Y | Y | Y | Y | Y | Y |
| Is y > 8000/x satisfied? | | N | Y | Y | Y | Y | N | N | N |
| Evaluation results | | | | | | | | | |
| Whiteness unevenness | | A | A | A | A | A | B | B | B |
| Spinnability | | B | B | A | A | A | B | B | B |

TABLE 1-continued

| Physical properties or production conditions | Unit | Examples 17 | 18 | 19 | 20 | 21 | 22 | 23 | 24 |
|---|---|---|---|---|---|---|---|---|---|
| Content of oxyethylene unit relative to 100 mol of oxymethylene unit | mol | 1.5 | 1.5 | 1.5 | 1.5 | 1.5 | 1.5 | 0.5 | 5 |
| Discharge amount per hole | kg/h · hole | 0.056 | 0.083 | 0.083 | 0.083 | 0.083 | 0.083 | 0.056 | 0.056 |
| Rate of take-off roller | m/min | 1300 | 2500 | 2500 | 3000 | 3000 | 2000 | 2000 | 2000 |
| Linear velocity of resin at discharge nozzle | m/min | 0.020 | 0.020 | 0.020 | 0.020 | 0.020 | 0.016 | 0.016 | 0.016 |
| Rate difference per unit distance (x) | l/sec | 5.4 | 10.4 | 10.4 | 12.5 | 12.5 | 8.3 | 8.3 | 8.3 |
| Diameter of polyacetal fiber (single fiber) after winding step | mm | 0.0130 | 0.0159 | 0.0145 | 0.0159 | 0.0145 | 0.0225 | 0.0145 | 0.0145 |
| Diameter of discharge nozzle | mm | 0.60 | 0.60 | 0.60 | 0.60 | 0.60 | 0.60 | 0.60 | 0.60 |
| Area ratio (y) | — | 2130 | 1424 | 1712 | 1424 | 1712 | 711 | 1712 | 1712 |
| 1600/x | | 295 | 154 | 154 | 128 | 128 | 192 | 192 | 192 |
| 8000/x | | 1477 | 768 | 768 | 640 | 640 | 960 | 960 | 960 |
| Is y > 1600/x satisfied? | | Y | Y | Y | Y | Y | Y | Y | Y |
| Is y > 8000/x satisfied? | | Y | Y | Y | Y | Y | N | Y | Y |
| Evaluation results | | | | | | | | | |
| Whiteness unevenness | | A | A | A | A | A | B | A | A |
| Spinnability | | A | A | A | A | A | A | C | B |

Y: Yes,
N: No

TABLE 2

| Physical properties or production conditions | Unit | Comparative Examples 1 | 2 | 3 | 4 | 5 | 6 | 7 | 8 |
|---|---|---|---|---|---|---|---|---|---|
| Content of oxyethylene unit relative to 100 mol of oxymethylene unit | mol | 1.5 | 1.5 | 1.5 | 1.5 | 1.5 | 1.5 | 0 | 8 |
| Discharge amount per hole | kg/h · hole | 0.037 | 0.044 | 0.044 | 0.028 | 0.028 | 0.250 | 0.037 | 0.044 |
| Rate of take-off roller | m/min | 400 | 580 | 500 | 200 | 800 | 1700 | 420 | 420 |
| Linear velocity of resin at discharge nozzle | m/min | 0.011 | 0.013 | 0.013 | 0.008 | 0.008 | 0.219 | 0.008 | 0.008 |
| Rate difference per unit distance (x) | l/sec | 1.7 | 2.4 | 2.1 | 0.8 | 3.3 | 7.1 | 1.7 | 1.7 |
| Diameter of polyacetal fiber (single fiber) after winding step | mm | 0.0217 | 0.0237 | 0.0237 | 0.0145 | 0.0290 | 0.0459 | ND | ND |
| Diameter of discharge nozzle | mm | 0.60 | 0.60 | 0.60 | 0.60 | 0.60 | 0.60 | 0.60 | 0.60 |
| Area ratio (y) | — | 762 | 641 | 641 | 1709 | 427 | 171 | ND | ND |
| 1600/x | | 960 | 662 | 768 | 1920 | 480 | 226 | 914 | 914 |
| 8000/x | | 4800 | 3310 | 3840 | 9600 | 2400 | 1130 | 4572 | 4572 |
| Is y > 1600/x satisfied? | | N | N | N | N | N | N | ND | ND |
| Is y > 8000/x satisfied? | | N | N | N | N | N | N | ND | ND |
| Evaluation results | | | | | | | | | |
| Whiteness unevenness | | D | D | D | D | D | D | ND | ND |
| Spinnability | | C | B | B | B | A | B | D | D |

Y: Yes,
N: No,
ND: unmeasurable

The invention claimed is:

1. A method for producing a polyacetal fiber, wherein:

the method comprises a discharge step, a take-off step, a drawing step and a winding step, the steps being successively carried out;

an oxymethylene copolymer is used as a raw material of the polyacetal fiber, the oxymethylene copolymer having an oxymethylene unit and an oxyethylene unit, the content of the oxyethylene unit being 0.5 to 7.0 mol relative to 100 mol of the oxymethylene unit;

the roller temperature of a drawing unit used in the drawing step is 130 to 155° C.; and when a value obtained by dividing a rate difference between a rate of discharging the oxymethylene copolymer from a discharge nozzle in the discharge step and a rate of taking off the fiber using a take-off roller in the take-off step by a distance between the discharge nozzle and the take-off roller is referred to as a rate difference per unit distance x (1/sec) and defined as formula (A):

$$\text{Rate difference per unit distance}(x)=(\text{rate of take-off roller(m/sec)}-\text{rate of discharging resin from discharge nozzle(m/sec)})/\text{distance}(m) \quad \text{(A)},$$

and the ratio between an area of the discharge nozzle and a cross-sectional area of the polyacetal fiber after the winding step is referred to as an area ratio y (no unit dimension) and defined as formula (B):

$$\text{Area ratio}(y)=\text{area of discharge nozzle}(mm^2)/\text{cross-sectional area of polyacetal fiber after winding step}(mm^2) \quad (B),$$

formula (C) below is satisfied:

$$y>1600/x \quad (C)$$

with the proviso that $1.5<x<15$.

2. The method according to claim 1, wherein $1400<y<2500$ is satisfied in formula (C).

3. The method according to claim 1, wherein formula (D) below is satisfied:

$$y>8000/x \quad (D)$$

with the proviso that $1.5<x<15$.

4. The method according to claim 2, wherein formula (D) below is satisfied:

$$y>8000/x \quad (D)$$

with the proviso that $1.5<x<15$.

* * * * *